US006785993B1

(12) United States Patent
Lea

(10) Patent No.: US 6,785,993 B1
(45) Date of Patent: Sep. 7, 2004

(54) HAZARD CLASSIFICATION PLACARD HOLDER

(76) Inventor: Dennis Lea, 4219 Western Reserve Dr., Brunswick, OH (US) 44212

( * ) Notice: Subject to any disclaimer, the term of this patent is extended or adjusted under 35 U.S.C. 154(b) by 104 days.

(21) Appl. No.: 10/260,113

(22) Filed: Sep. 27, 2002

(51) Int. Cl.[7] ..... G09F 21/04

(52) U.S. Cl. ..... 40/643; 40/649; 40/652; 40/588; 40/591; 40/611.05; 40/611.07; 40/611.08; 40/618

(58) Field of Search ..... 40/643, 649, 652, 40/661.11, 588, 591, 606.01, 611.05, 611.01, 611.07, 611.08, 618

(56) References Cited

U.S. PATENT DOCUMENTS

| | | | | | |
|---|---|---|---|---|---|
| 3,481,059 | A | * | 12/1969 | Lowmaster | 40/643 |
| 3,496,665 | A | * | 2/1970 | Goldman | 40/591 |
| 3,496,666 | A | * | 2/1970 | Morley | 40/591 |
| 3,510,975 | A | * | 5/1970 | Lowmaster | 40/591 |
| 3,518,782 | A | * | 7/1970 | Long | 40/588 |
| 4,094,083 | A | * | 6/1978 | Fund | 40/536 |
| 4,106,229 | A | * | 8/1978 | Schmid | 40/611.12 |
| 4,715,138 | A | * | 12/1987 | Cherico | 40/591 |

OTHER PUBLICATIONS

U.S. Government, "Appendix C to Part 172—Dimmensional Specifications for Recommended Placard Holder", Appendix C to 49 CFR 172, Oct. 1, 2000, Appendix C, Title 49, vol. 2, U.S. Government Printing Office, Washington DC, U.S.

* cited by examiner

*Primary Examiner*—Gary C. Hoge
(74) *Attorney, Agent, or Firm*—Christopher L. Parmelee; Walker & Jocke, LPA

(57) ABSTRACT

A placard holder apparatus and method is provided. The apparatus includes a bracket mounted to a vehicle that is operative to transport a hazardous material. The bracket is operative to slidingly receive and engage with a placard holder. A placard clip may be mounted to the vehicle to prevent the placard holder from exiting the bracket. The placard holder includes a tray with a cavity of sufficient depth to hold a stack of adhesively mounted placards. For each shipment of a hazardous material in the vehicle, a placard with indicia representative of a hazard classification corresponding to the hazardous material may be adhesively mounted in the cavity of the tray. Once the cavity is filled with placards, the placard holder may be removed and replaced with an empty or less full placard holder. The full placard holder may be discarded or recycled to remove the adhesively mounted placards therein.

28 Claims, 8 Drawing Sheets

HAZARD CLASSIFICATION PLACARD HOLDER

TECHNICAL FIELD

This invention hazard classification placards. Specifically, this invention relates to an apparatus and method for mounting hazard classification placards on vehicles.

BACKGROUND ART

U.S. Federal regulations designate specific materials as hazardous for purposes of transportation (49 C.F.R. Sec. 172.101). For each hazardous material, U.S. regulations further specify requirements for identifying these hazardous materials when being transported with vehicles such as trucks, truck trailers, trains, tank cars, cargo tanks and other transport vehicles. The specified hazardous materials are currently placed in a plurality of categories based on their chemical and physical properties. These categories include: Class 1—Explosives; Class 2—Gases; Class 3—Flammable liquids; Class 4—Flammable solids, spontaneously combustible materials and materials that are dangerous when wet; Class 5—Oxidizers and organic peroxides; Class 6—Poisons and etiologic materials; Class 7—Radioactive materials; Class 8—Corrosives; Class 9—Miscellaneous; and ORM-D—Other regulated material.

The U.S. Department of Transportation requires placarding of vehicles to notify the transportation workers, emergency workers and the public in general to the presence and type of hazardous materials contained in the vehicles. The placards are required to have specific indicia such as graphics, text, and color that classify the hazardous material being transported by the vehicle.

FIG. 1 shows an example of a placard 10 for use in identifying explosive materials found in Class 1. Here the generally rectangular or diamond shaped placard includes the indicia 12 representative of the general hazard class 1 in which explosives are listed. The placard also includes the indicia 14 representative of the English word for the name of the hazard class "EXPLOSIVES" and indica 16 representative of the class and subclass for the hazardous material. Here the class/subclass indica of "1.4" corresponds to explosives with no significant blast hazard. For other hazardous materials, U.S. regulations may specify a particular graphic to represent the class/subclass specified for hazardous materials. For example, a Flammable Gas corresponding to class/subclass 2.1 is depicted on a placard with a graphic of a flame.

U.S. regulations may also require an identification number (UN number) associated with the specific type of material to be located on the vehicle. In some configurations, as shown in FIG. 2, the previously described diamond shaped warning placard 20 may include indicia 22 representative of the UN identification number in place of the English description of the hazard class, but not in place of the graphic 24. In other configurations, the UN identification number 32 of the material may be placed on a separate elongated rectangular placard 30 as shown in FIG. 3.

FIG. 4 shows an example of a transportation vehicle 40 such as a truck, which includes the previously described hazard class warning placard 44 and UN identification placard 42. Depending on the regulations for the hazardous material being shipped, the vehicle may require placards positioned on each side, back and/or front of the vehicle.

Trucks and other transportation vehicles have the capacity to transport different types of hazardous material. Thus, the placards affixed to the vehicle must periodically be reconfigured to reflect the different material being contained in the vehicle. One inexpensive method of applying hazard classification placards includes affixing adhesive labels directly to the surface of the vehicle which have the proper size, shape and correct indicia to correspond to a placard under U.S. regulations. Another method of affixing placards to vehicles includes the use of placards in the form of rigid pages that are hinged to the side of the vehicle. Multiple pages representative of different hazard class placards may be hinged to the vehicle. When a different material is placed in the vehicle, the pages may be flipped to display the placard corresponding to the hazard class of the new material.

Unfortunately, each of these methods of affixing placards to a vehicle has disadvantages. For example, U.S. regulations require that when new placards are visible on a vehicle, that no portion of any previously placards for different classes of hazardous material be visible. With adhesive labels, this requirement results in the vehicle undergoing a labor intensive and time consuming process to remove the old labels from the sides of the vehicles. For hinged placards, individual pages may become torn or otherwise ripped from the vehicle revealing portions of other placards of the wrong class. Reparing hinged placards is often labor intensive and time consuming.

Under U.S. regulations, significant fines for violation of the regulations regarding placards may be imposed. Further, vehicles with defective placarding may be stopped and prevented from continuing with their route until the deficiency in the placarding is corrected. For hinged and adhesive labels, the difficulty in quickly correcting the placarding, may significantly delay the delivery of the material and/or the use of the vehicle. Consequently, there exists a need for a time, labor and cost efficient apparatus and method of mounting, replacing, changing, removing and repairing hazard classification placards on a vehicle.

DISCLOSURE OF INVENTION

It is an object of an exemplary form of the present invention to provide a hazard classification placard.

It is a further object of an exemplary form of the present invention to provide an apparatus and method of mounting hazard classification placards.

It is a further object of an exemplary form of the present invention to provide an apparatus and method of mounting hazard classification placards to vehicles.

Further objects of exemplary forms of the present invention will be made apparent in the following Best Modes for Carrying Out Invention and the appended claims.

The foregoing objects may be accomplished in an exemplary embodiment by a placard holder that includes a tray with a cavity that is operative to receive therein a plurality of stacked placards. The placard holder may be releasably mounted to a vehicle that transports hazardous material. When a new hazardous material is placed in a container of the vehicle, a new placard may be adhesively mounted in the tray on top of any previously mounted placards. In the exemplary embodiment, the placards may include an adhesive backing layer that enables the placards to be adhesively mounted quickly and securely to the base of the tray or the top surface of any previously existing placards. The depth of the tray for example may be sufficient to hold 10 or more stacked placards therein. In one exemplary embodiment, the cavity of the tray may have a depth of about ½ inch and be operative to hold a stack of about 30 placards. As a result the vehicle may be operative to transport hazardous materials which require 30 different changes to the placards before the tray is filled.

In the exemplary embodiment, the apparatus may include a bracket securely mounted to a surface of the vehicle that is in operative connection with the container that holds the hazardous material. The bracket may include parallel side portions with either slots or flanges that are operative to cooperatively engage with corresponding flanges or slots in the sides of the placard holder as the placard holder is slid into the bracket. A locking device such as a placard clip mounted to the surface of the vehicle may by moved to a position which prevents the placard holder from exiting the bracket.

When the cavity of the placard holder becomes filled with a stack of placards, the placard holder may be removed from the bracket and replaced with an empty or less filled placard holder. In addition, the filled placard holder may be recycled by applying a solution to the placard with is operative to dissolve or loosen the adhesive bond of the placards therein so that the placards may be removed from the placard holder.

BEST MODES FOR CARRYING OUT INVENTION

Figure 5:
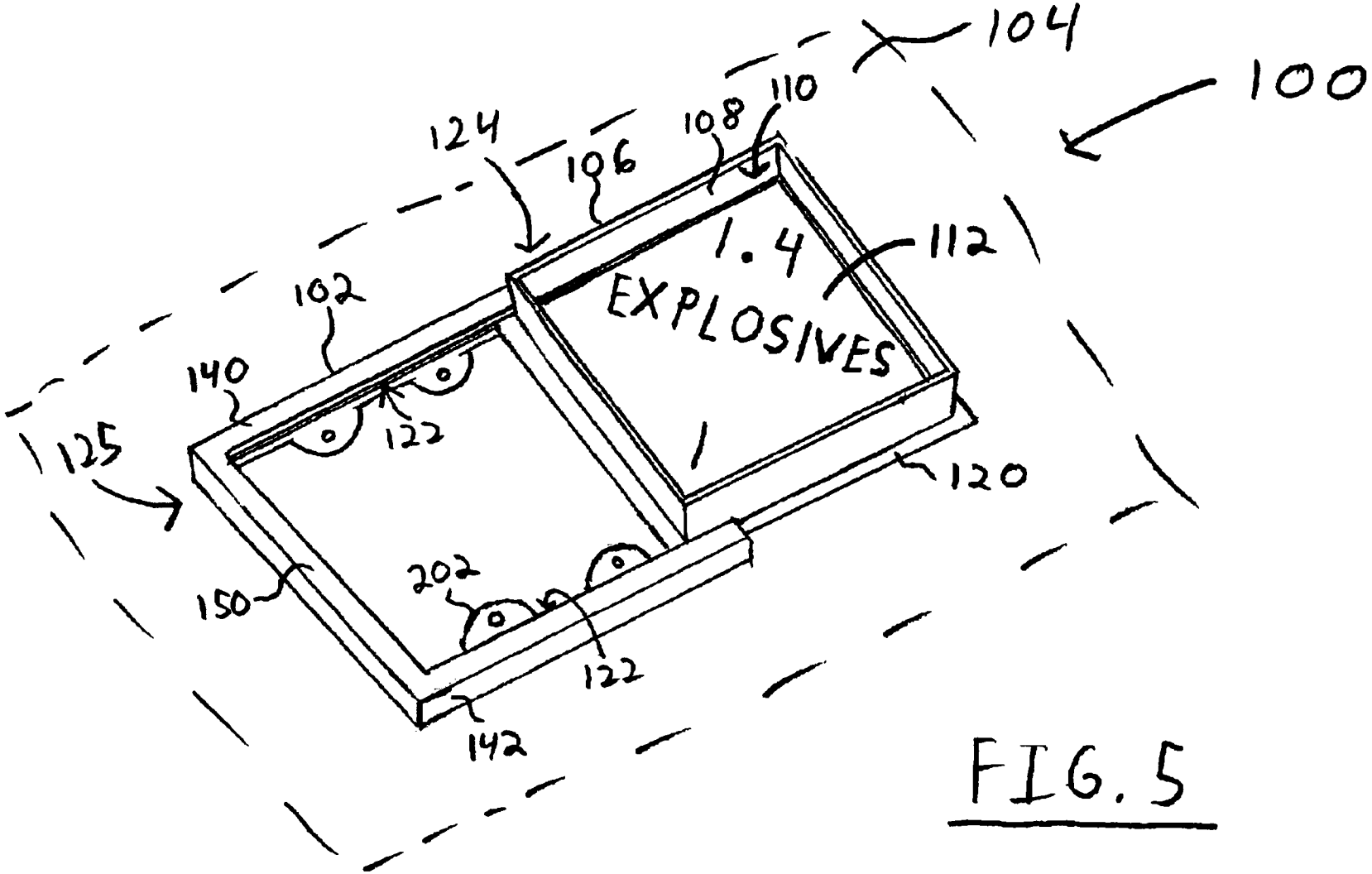
FIG. 5 is a perspective view representative of an exemplary embodiment of a placard holder being slid into a bracket.

Referring now to the drawings and particularly to FIG. 5, there is shown therein a perspective view of an exemplary embodiment of a placard apparatus 100. Here the placard apparatus includes a bracket 102 adapted to mount to a surface of a vehicle 104. As used herein and in the claims, the term vehicle encompasses any device or container used to transport hazardous materials, including but not limited to trucks, truck trailers, trains, tank cars, cargo tanks and other apparatus used to transport hazardous materials.

As shown in FIG. 5, the apparatus further includes a placard holder 106 in releasable sliding connection with the bracket 102. The placard holder may include a tray 108 with a generally rectangular shaped cavity 110 therein. In the exemplary embodiment, the cavity has a sufficient depth to receive a plurality of stacked rectangular placards 112 therein.

Figure 1:
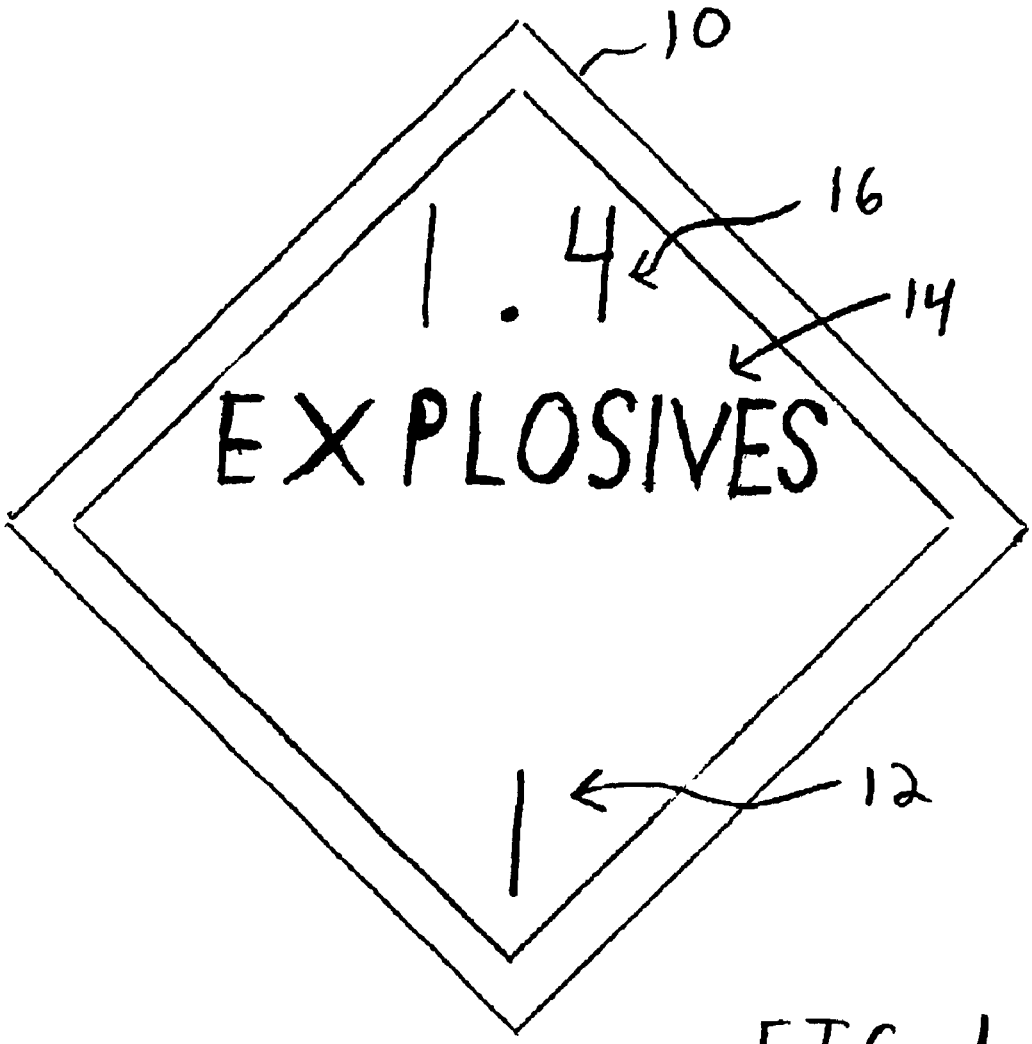
FIG. 1 is a flat plan view representative of an exemplary embodiment of a Hazard Classification Placard.
Figure 2:
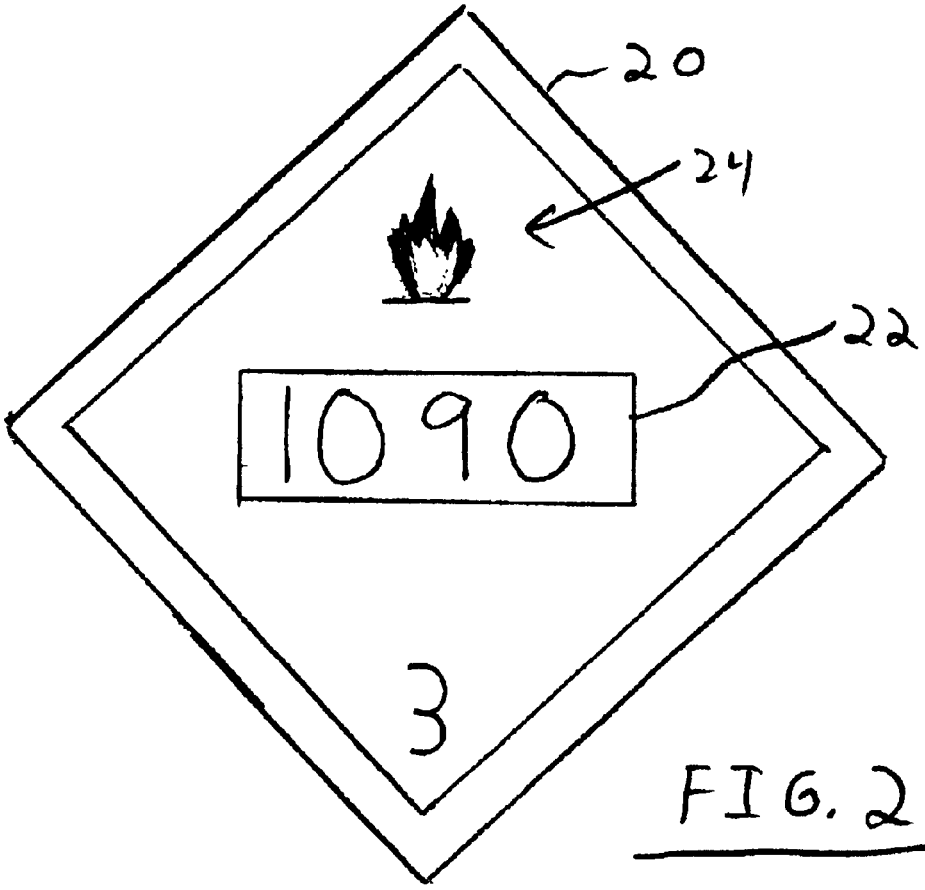
FIG. 2 is a flat plan view representative of an exemplary embodiment of a Hazard Classification Placard.
Figure 3:
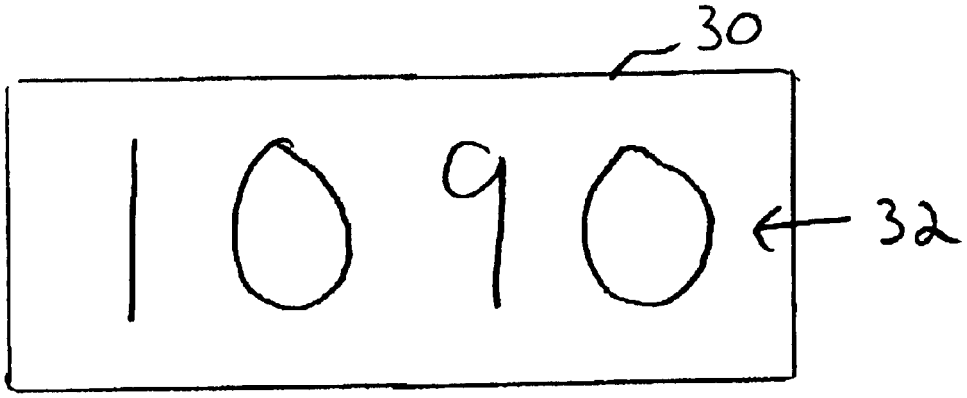
FIG. 3 is a flat plan view representative of an exemplary embodiment of UN identification number placard.
Figure 4:
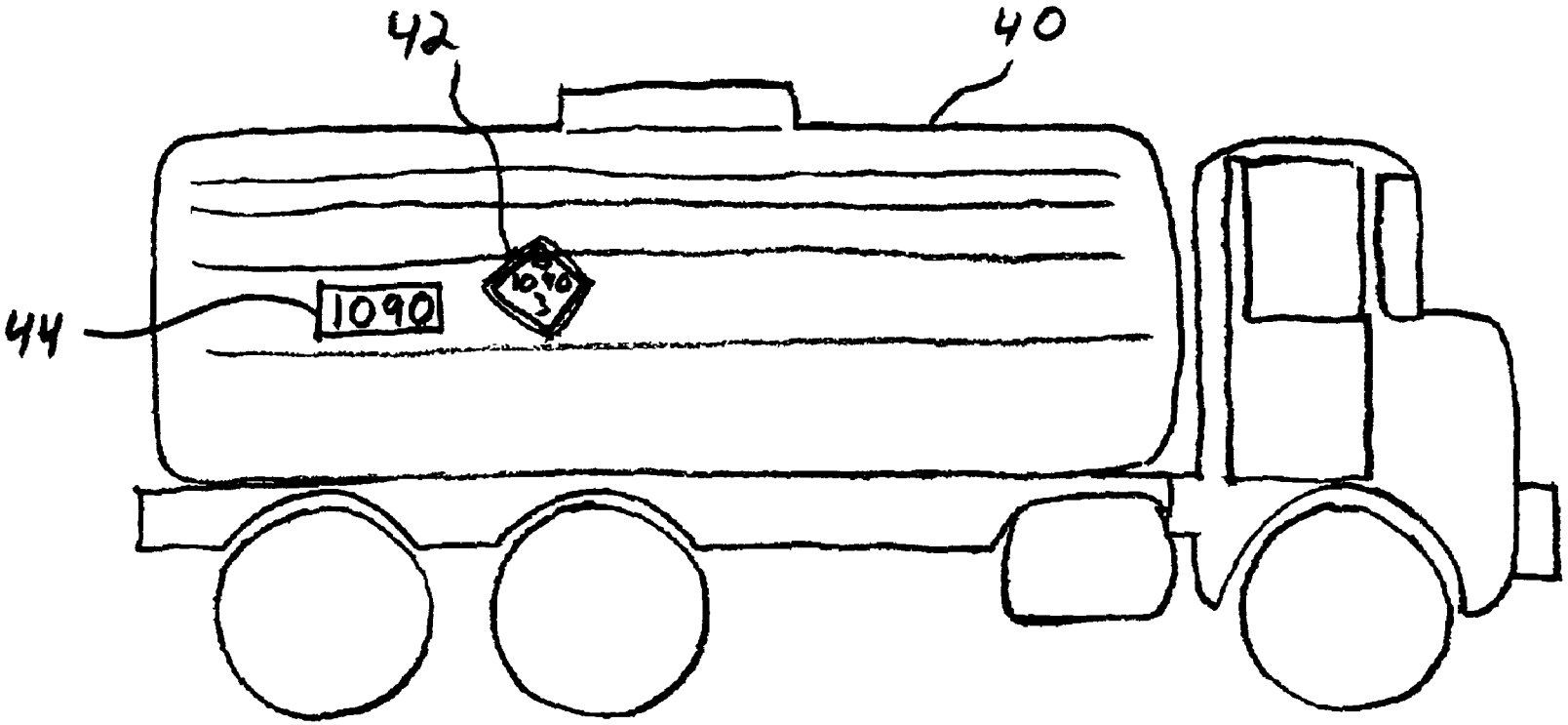
FIG. 4 is side plan view representative of an exemplary embodiment of a Hazard Classification Placard affixed to a vehicle.

In one exemplary embodiment, the cavity may have a diamond shape that is operative to accept warning placards with indicia representative of a hazardous classification such as the placards shown in FIGS. 1 and 2. To accept placards conforming to U.S. regulations for transportation of hazardous materials, each side of the cavity may have a width of at least 10.75 inches. However, it is to be understood that in other embodiments the cavity 110 may have other dimensions depending on the size of the placards being mounted in the cavity. For example, the placard holder may have an elongated rectangular shape that is operative to except rectangular placards such as shown in FIG. 3 with the UN identification number for the hazardous material being transported. As used herein and in the claims, a generally rectangular shaped cavity of the placard holder may include rounded corners and other non-uniform contours, as long as the overall shape of the cavity generally corresponds to and is operative to receive therein either an elongated rectangular, square, and/or diamond shaped placard.

Figure 6:
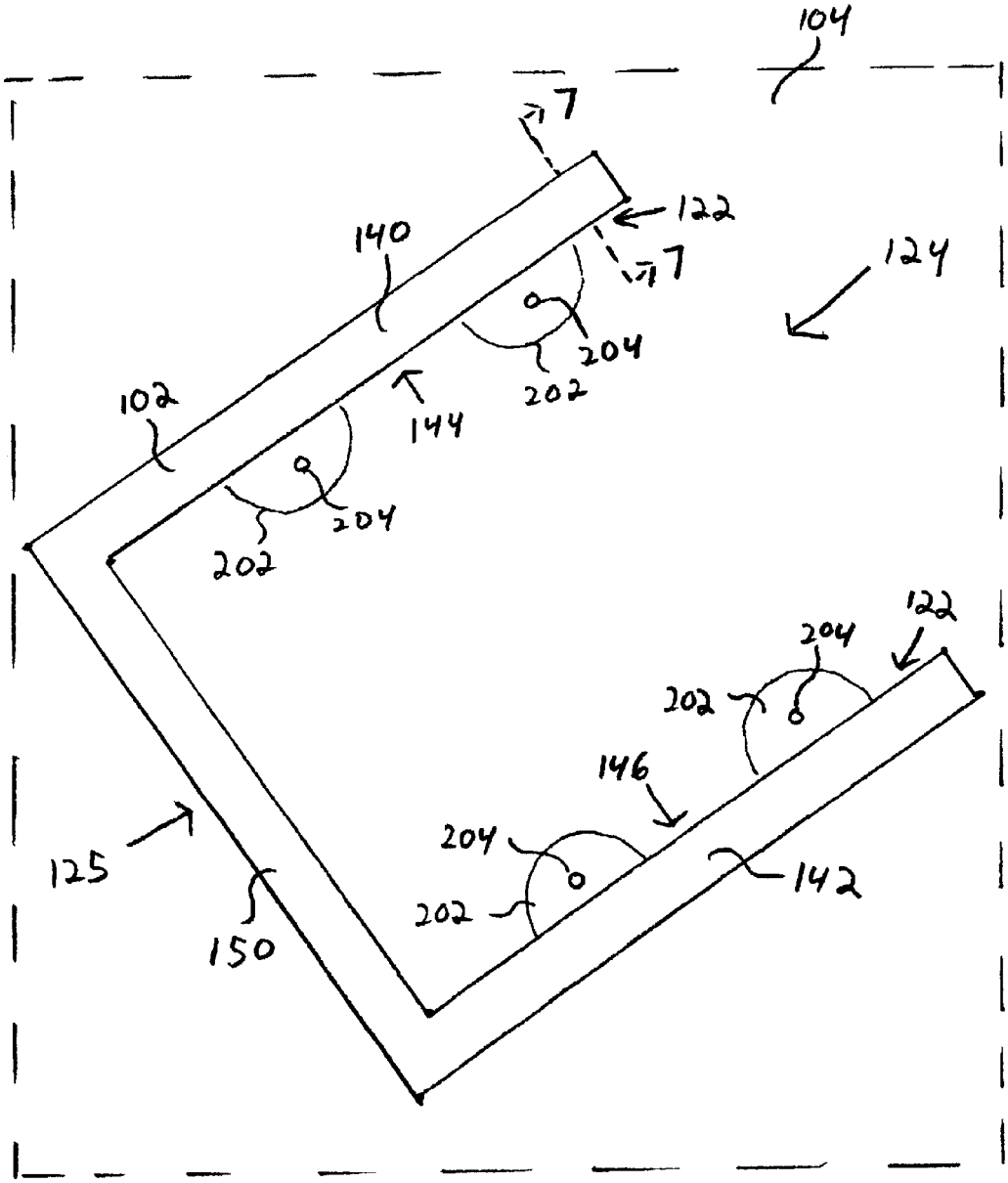
FIG. 6 is top plan view representative of an exemplary embodiment of the bracket.
Figure 7:
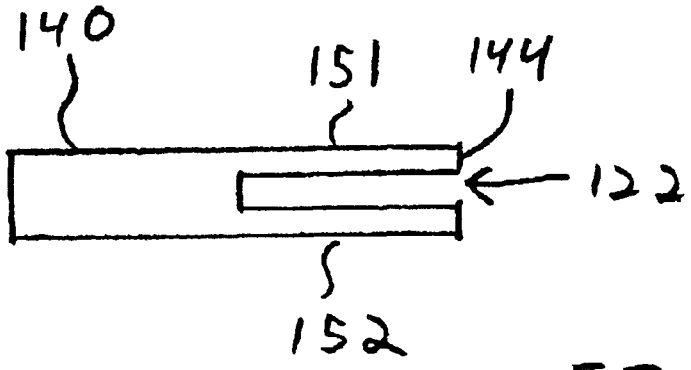
FIG. 7 is cross-sectional view of an exemplary embodiment of a side portion of the bracket.
Figure 8:
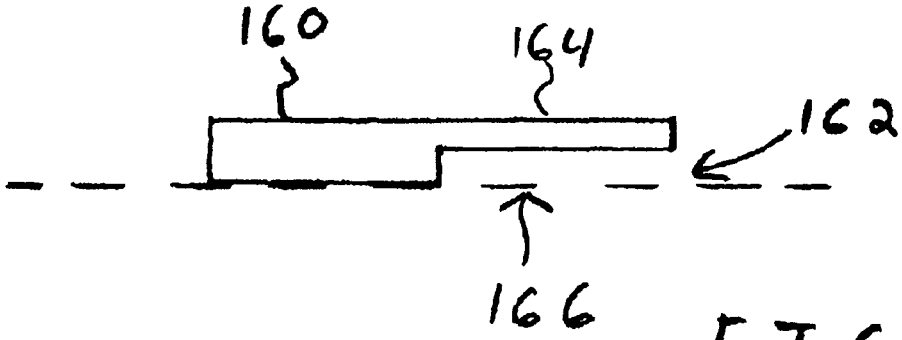
FIG. 8 is cross-sections view of an alternative exemplary embodiment a side portion of the bracket.

In the exemplary embodiment, the bracket and placard holder include cooperating pairs of projections and apertures such as flanges 120 and slots 122 respectively which enable the placard holder to releasably slide into and out of at least one first end 124 of the bracket. For example, as shown in FIG. 6, in an exemplary embodiment the bracket 102 may include two parallel side portions 140, 142. Each of the side portions 140, 142 of the bracket may include a longitudinal slot generally indicated 122 extending along the inner surfaces 144, 146 of the side portions 14, 142. FIG. 7 shows a cross-sectional view of a side portion 140 of the bracket. Here the slot 122 is shown extending into the side portion 144 of the bracket and is bounded by both an upper wall 151 and a lower wall 152. However, it is to be understood that alternative exemplary embodiments may have other configurations for the slots 122. For example, as shown in FIG. 8, a side portion 160 of an exemplary embodiment of a bracket may include an upper wall 164 that bounds the slot 162, but no lower wall. Rather, when the bracket is mounted to a vehicle, the surface 166 of the vehicle may bound the other side of the slot 162.

Figure 9:
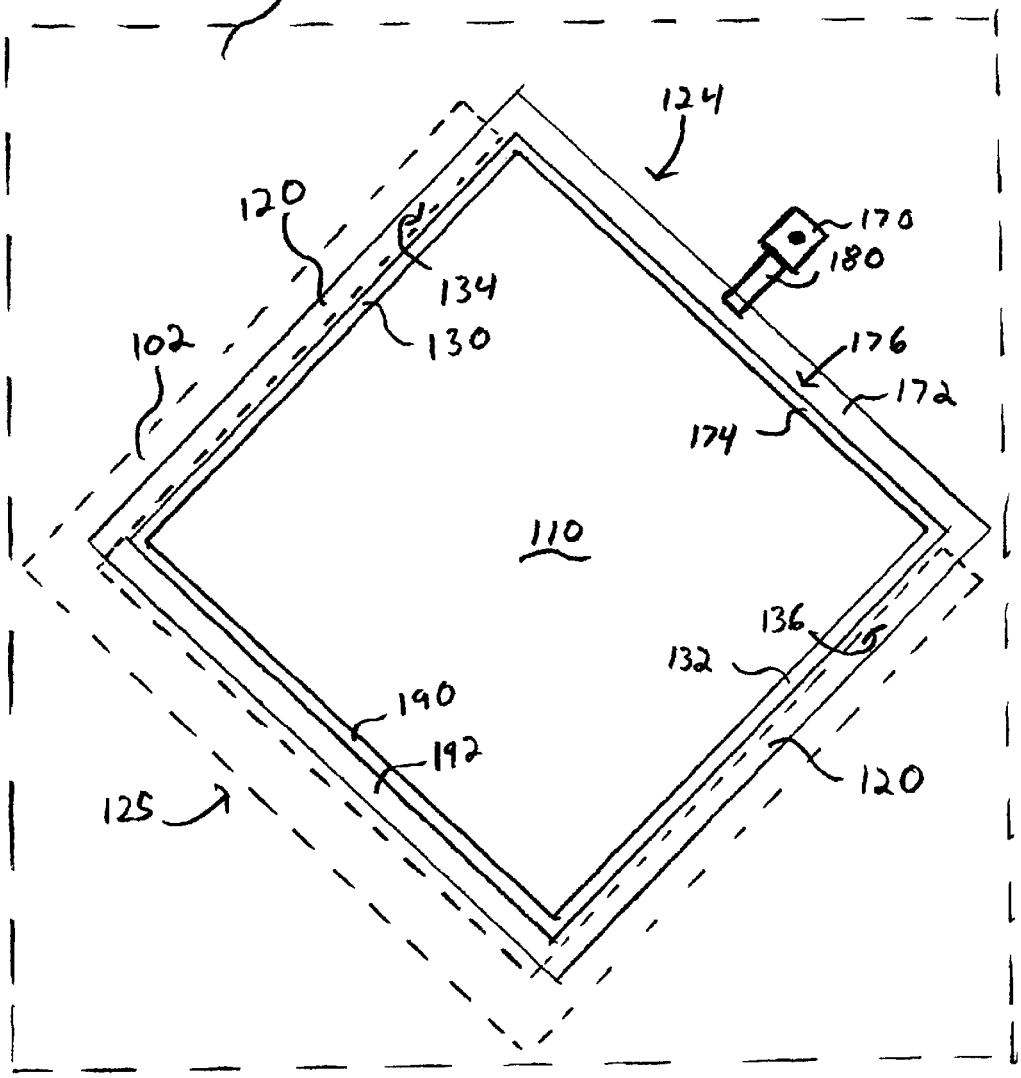
FIG. 9 is top plan view representative of an exemplary embodiment of the placard holder.
Figure 10:
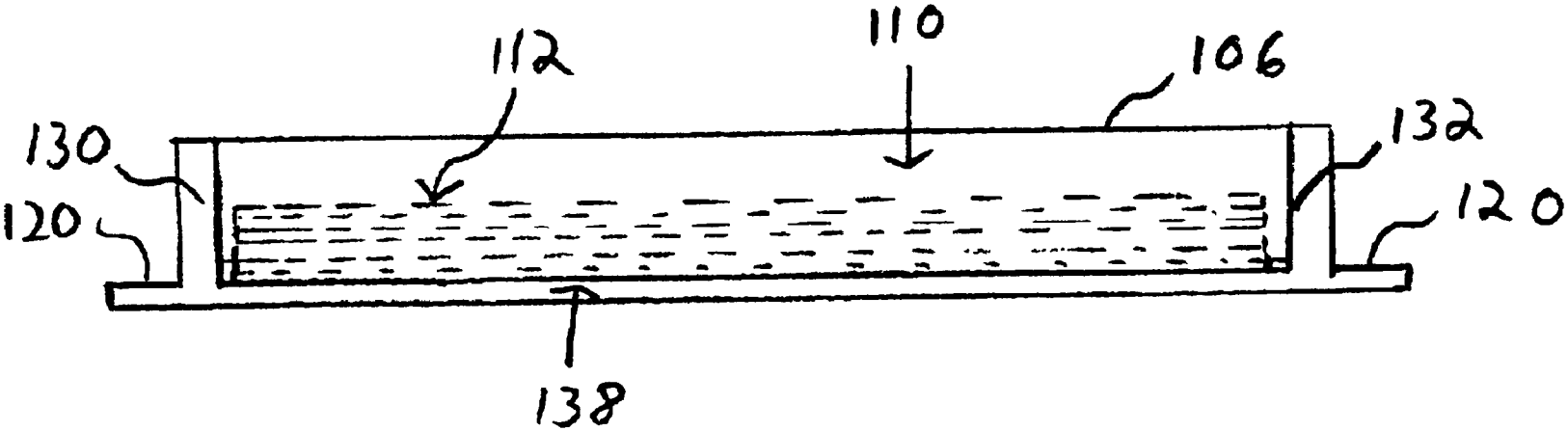
FIG. 10 is cross-sections view of an exemplary embodiment of the placard holder.

FIG. 9, shows a top plan view of the placard holder 106. In this described exemplary embodiment, the placard holder may include two parallel side potions 130, 132. Each of the parallel side portions 130, 132 of the placard holder may include a longitudinal flange 120 extending outwardly from the outer surfaces 134, 136 of the parallel side portions 130, 132. FIG. 10 shows a cross-sectional view of an exemplary embodiment of the placard holder 106. Here the flanges 120 are positioned in the same general plane as the base 138 of the cavity 110 of the placard holder. In alternative exemplary embodiments, the flanges 120 may be position higher or lower with respect to the plane that includes the base 138 of the cavity.

As shown in FIGS. 5, 6, and 9, the flanges 120 are included in the placard holder 106 and the slots 120 are includes in the bracket 102. However, it is to be understood that in alternative exemplary embodiments, the bracket may include the flanges extending inwardly from the inner surfaces of the side portion of the bracket, and the placard holder may include slots along the outer surfaces of the side portions of the placard holder. In other exemplary embodiments, other configurations and orientations of an interengaging slot and flange may be provided to enable the bracket to slidingly receive the placard holder.

As shown in FIG. 5, in the exemplary embodiment, the side portions 140 and 142 are connected together with a further side portion 150 adjacent a second end 125 of the bracket. When the placard holder is slid into the bracket through the first end 124, the further side portion 150 may have a sufficient height above the surface of the vehicle to block the placard holder 106 from sliding out of the bracket 102 through the second end 125 of the bracket. In alternative exemplary embodiments, the side portions may be connected together at other points along the length of the bracket. Also, further exemplary embodiments may have a further side portion 150 that is not directly connected to the side portions 140, 142. Rather, the further side portion may be mounted independently to the surface of the truck to facilitate blocking the placard holder 106 from sliding out of the bracket 102. Likewise, in alterative exemplary embodiments, the side portions 140, 142 may be independent bracket parts that are individually mounted to a surface of a vehicle in parallel positions so as to be able to receive the flanges of the placard holder.

As shown in FIG. 9, the apparatus may further include a locking device such as a placard clip 170 mounted to the surface of the vehicle or alternatively mounted to a portion of the bracket adjacent the first end 124 of the bracket. The exemplary embodiment of the placard holder 106 may include a projection such as a further flange 172 extending from an outer surface 176 of a further side portion 174 of the placard holder 106. To further prevent the placard holder from sliding out of the bracket adjacent the first end 124 of the bracket, the placard clip may include an arm 180 which may be lifted or rotated into a position overtop of the further flange 172 of the placard holder. In alternative exemplary embodiments, other locking devices may be employed to prevent the placard holder from sliding out of the bracket. In further exemplary embodiments the further side portion 150 of the bracket may be replaced with a locking device such as a placard clip to prevent the placard holder from sliding out of the second end 125 of the bracket.

To enable the placard holder to be slid into the bracket in four different rotational orientations, both the further sides 174, 190 of the placard holder may include further flanges 172, 192 which have a compatible configuration as the flanges 120 of the sides portions 130, 132. As a result, placard holder may also be inserted into the bracket in an orientation in which the flanges 172, 190 slid through the slots 120 of the bracket. In this scenario, the placard clip 170 may be lifted or rotated into a position overtop of one of the flanges 120 to prevent the placard holder from sliding out of the first end 124 of the bracket.

In the exemplary embodiment, the cavity 110 may have a sufficient depth between ¼ inch and ¾ inch for example to be capable of holding 10 or more adhesively mounted placards therein. For example, for a common thickness of adhesively applied placard stickers, a cavity with a depth of about ½ inch may be used to hold about 30 adhesively affixed placards.

As shown in FIG. 6, the bracket may include one or more mounting flanges 202 which extend inwardly from the side portions 140 142 of the bracket. The mounting flanges may include holes 204 therein to accept a bolt, screw, rivet or other fastener therethrough for mounting the bracket to the surface 104 of the vehicle. In this described exemplary embodiment, the mounting flanges extend from the inner surfaces 144, 146 of the side portions 140, 142 beneath the slots 122 so as to not obstruct the insertion of the placard holder into the bracket. In other exemplary embodiments mounting flanges may extend inwardly from the further side portion 150. Also, in alternative exemplary embodiments, the mounting flanges may be positioned to extend outwardly from the side portions 140, 142, 150. Also in alternative exemplary embodiments, the bracket may not include further mounting flanges but rather may have fastener holes through the side portions 140, 142, 150. In exemplary embodiments in which the bracket includes parallel slots 122, the holes in the side portions 140, 142 of the bracket may be placed in locations which would not interfere with the insertion of the flanges from the placard holder through the slots 122.

An exemplary embodiment of a method in which the placard apparatus is used may include providing at least one bracket mounted to a surface of a vehicle. The previous described brackets for example may be riveted, bolted or otherwise fastened to one or more locations on the vehicle. The method may further include providing at least one locking device such as a placard clip to the surface of the vehicle in the location of the first end of the bracket.

Once mounted an exemplary embodiment of the previously described placard holder may be slid into the bracket. To prevent the placard holder from sliding back out of the bracket, an arm of the placard clip may be moved overtop of a flange of the placard holder. Depending on the contents of the vehicle an adhesive backed placard with indicia representative of a hazard classification corresponding to the hazardous material being transported by the vehicle may be adhesively mounted to the base of the cavity of the placard holder. In embodiments where the slots of the apparatus are about parallel to the surface of the vehicle, the placard holder may be slid into the bracket in a direction that is about parallel with the surface of the bracket.

Once the correct hazard classification placard has been mounted in the placard holder, the vehicle may be used to transport the hazardous material. At some point the contents of the vehicle may be removed and replaced with a hazardous material which corresponds to a different hazard class. As a result, different placards will need to be fixed to the vehicle that corresponds to the different material. In the exemplary embodiment, a new adhesive backed placard may be inserted into the cavity of the placard holder and may be adhesively mounted to the outer surface of the existing placard(s).

In the exemplary embodiment, the walls bounding the cavity of the placard holder may be operative to limit the amount of dirt and other debris that contact the placard. In addition, when further placards are inserted into the cavity, the walls may assist the user in aligning the further placards overtop of the existing placards so that substantially all of the underlining placards are covered by the further placard.

When the vehicle is being used to transport a nonhazardous material which does not require placarding, or when the vehicle is traveling empty, a generally blank adhesive backed placard may be applied overtop of the existing placards in the cavity. Such a blank placard may include a visible surface that is all white, for example, with no indicia representative of a hazard classification.

In the exemplary embodiment, when the cavity of the placard holder is filled with a stack of placards adhesively mounted there, the placard holder may be dismounted from the bracket and either replaced with an empty or less filled placard holder, and/or may be cleaned to remove the existing placards. For example, a solvent or a solution of an adhesive dissolving material may be applied to the placards in the placard holder to facilitate removing the placards from the placard holder. The placard holder may then be remounted to the same or a different bracket of the same or a different vehicle and new placards may be adhesively mounted therein.

In the exemplary embodiment, the placard holder and bracket may be comprised of materials including metals, plastics or any other durable weather resistant material. In addition, although the exemplary embodiments of the placard apparatus have been described as being mounted to vehicles, exemplary embodiments of the placard apparatus may further be mounted to other hazardous material containers including storage tanks, and other fixed or movable containers.

Thus, the new hazard classification placard holder apparatus and method achieves one or more of the above stated objectives, eliminates difficulties encountered in the use of prior devices and systems, solves problems and attains the desirable results described herein.

In the foregoing description, certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. A placard apparatus comprising:

a vehicle;

at least one bracket mounted to the vehicle;

at least one placard holder in releasable connection with the bracket, wherein the at least one placard holder includes a tray with a generally rectangular shaped cavity therein, wherein the cavity has a sufficient depth to receive a plurality of stacked placards therein, wherein the at least one placard holder includes the plurality of stacked placards adhesively mounted within the cavity, wherein the width of at least one side of the cavity is at least 10.75 inches; and a plurality of interengaging slots and flanges, wherein one of either the bracket and the placard holder includes two of the slots positioned in parallel, and the other one of either the bracket and placard holder includes at least two of the flanges positioned in parallel, and whereby the placard holder is releasably supported to the bracket through the sliding engagement of the two flanges through the two slots.

2. The apparatus according to claim 1, wherein at least one of the placards includes indicia representative of a hazard classification.

3. A placard apparatus comprising:

at least one bracket adapted to mount to a vehicle;

a placard holder in releasable connection with the at least one bracket, wherein the placard holder includes a tray with a generally rectangular shaped cavity therein, wherein the cavity has a sufficient depth to receive a plurality of stacked placards therein; and a plurality of interengaging slots and flanges, wherein one of either the bracket and the placard holder includes two of the slots positioned in parallel, and the other one of either the bracket and placard holder includes at least two of the flanges positioned in parallel, and whereby the placard holder is releasably supported to the bracket through the sliding engagement of the two flanges through the two slots, wherein the tray of the placard holder includes at least four sides, wherein the four sides include either flanges or slots, whereby the bracket is operative to slidingly receive the placard holder in four different rotational orientations.

4. The apparatus according to claim 3, wherein the cavity has a diamond shape with a sufficient size to accept a diamond shaped placard mounted therein with a width for each side of the placard of at least 10.75 inches, wherein the depth of the cavity is at least ¼ inch.

5. The apparatus according to claim 3, wherein the at least one bracket includes at least one hole therethrough, wherein the at least one hole is operative to receive a fastener therethrough for mounting the at least one bracket to the vehicle.

6. The apparatus according to claim 5, wherein the at least one bracket includes two side portions adapted to receive the placard holder therebetween, wherein the at least one bracket includes at least one mounting flange extending inwardly from at least one of the side portions, wherein the at least one mounting flange includes the at least one hole.

7. The apparatus according to claim 6, wherein the at least one bracket includes a further side portion in operative connection between the two side portions, wherein the further side portion has a sufficient height to block the placard holder from disengaging from the at least one bracket adjacent the further side portion.

8. A placard apparatus comprising:

at least one bracket adapted to mount to a vehicle;

a placard holder in releasable connection with the at least one bracket, wherein the placard holder includes a tray with a generally rectangular shaped cavity therein, wherein the cavity has a sufficient depth to receive a plurality of stacked placards therein;

a plurality of interengaging slots and flanges, wherein one of either the bracket and the placard holder includes two of the slots positioned in parallel, and the other one of either the bracket and placard holder includes at least two of the flanges positioned in parallel, and whereby the placard holder is releasably supported to the bracket through the sliding engagement of the two flanges through the two slots; and a locking device, wherein the placard holder includes a further flange, wherein when the at least one bracket is mounted to the vehicle and the placard holder is mounted to the at least one bracket, the locking device is operative to engage with the further flange to prevent the placard holder from dismounting from the at least one bracket in at least one direction.

9. An apparatus comprising at least one bracket;

at least one placard holder in releasable sliding connection with the bracket, wherein the at least one placard holder includes a tray with a generally diamond shaped cavity therein, wherein the cavity has a sufficient depth to receive at least 10 stacked placards therein, wherein the width of each side of the cavity is at least 10.75 inches; and at least one interengaging aperture and projection, wherein one of either the at least one bracket and the placard holder includes the at least one aperture, and the other one of either the at least one bracket and placard holder includes the at least one projection, and whereby the placard holder is releasably supported to the at least one bracket through engagement of the at least one projection with the at least one aperture;

a vehicle, wherein the vehicle includes the at least one bracket mounted thereto; and the plurality of stacked placards adhesively mounted within the cavity of the at least one bracket.

10. The apparatus according to claim 9, wherein the at least one aperture includes an elongated slot and the at least one projection includes an elongated flange, wherein the flange is operative to slide relatively within the slot to engage the placard holder with the at least one bracket.

11. The apparatus according to claim 10, wherein one of either the at least one bracket and the placard holder includes two parallel slots, wherein the other one of either the at least one bracket and the placard holder includes two parallel flanges.

12. The apparatus according to claim 9, wherein at least one of the placards includes indicia representative of a hazard classification.

13. A method comprising:

a) providing at least one bracket mounted to a surface in operative connection with a container that includes a hazardous material;

b) sliding at least one placard holder into the at least one bracket, wherein the at least one placard holder includes a tray with a cavity therein; and c) adhesively mounting at least one first placard in the cavity of the at least one placard holder, wherein the at least one first placard includes indicia representative of a hazard classification corresponding to the hazardous material.

14. The method according to claim 13, wherein in step (a) a vehicle includes the container.

15. The method according to claim 13, wherein further comprising:

d) placing a different material in the container; and e) adhesively mounting at least one second placard to the at least one first placard.

16. The method according to claim 15, wherein in step (e) the at least one second placard covers about all of the at least one first placard, wherein the cavity, the first placard and the second placard have a generally diamond shape.

17. The method according to claim 16, wherein in step (e) the at least one second placard includes indicia representative a hazard classification which corresponds to the different material, wherein the first hazard classification is different than the second hazard classification.

18. The method according to claim 16, wherein in step (e) the second placard includes a visible surface that is substantially blank with no indicia representative of a hazard classification.

19. The method according to claim 15, further comprising:

f) sliding the at least one placard holder from the at least one bracket;

g) recycling the at least one placard holder by removing the at least one first placard and the at least one second placard from the at least one placard holder;

h) sliding the at least one placard holder into the at least one bracket or into at least one further bracket; and i) adhesively mounting at least one third placard in the cavity of the at least one placard holder, wherein the at least one third placard includes indicia representative of a hazard classification.

20. The method according to claim 13, wherein in step (c) the indicia representative of the hazard classification corresponding to the markings for placards required under 49 CFR § 172.

21. The method according to claim 13, wherein step (a) includes riveting the at least one bracket to a vehicle.

22. The method according to claim 13, wherein in step (a) a trailer of a truck includes the container, wherein the at least one bracket is mounted to the trailer of the truck.

23. The method according to claim 13, wherein the at least one bracket and the at least one placard holder include cooperating parallel sets of grooves and flanges, wherein step (b) includes sliding the flanges through the grooves.

24. The method according to claim 13, wherein in step (c) at least one side of the cavity is at least 10.75 inches in width.

25. The method according to claim 24, wherein in step (c) the depth of the cavity is at least ¼ inch.

26. The method according to claim 13, wherein in step (a) the container corresponds to a storage tank.

27. The method according to claim 13, wherein in step (a) a train car includes the container.

28. The method according to claim 13, wherein further comprising:

d) providing at least one placard clip mounted to the surface; and e) locking the at least one placard holder to the at least one bracket with the at least one placard clip.

* * * * *